US006118111A

United States Patent [19]

Price et al.

[11] Patent Number: 6,118,111

[45] Date of Patent: Sep. 12, 2000

[54] FLUID HEATER

[75] Inventors: Nigel Brent Price; William Richard Fright, both of Christchurch; Mark Arthur Nixon, Wellington; Bruce Clinton McCallum, Christchurch, all of New Zealand

[73] Assignee: BBMR Limited, Christchurch, New Zealand

[21] Appl. No.: 09/142,833

[22] PCT Filed: Mar. 14, 1997

[86] PCT No.: PCT/NZ97/00030

§ 371 Date: Nov. 5, 1998

§ 102(e) Date: Nov. 5, 1998

[87] PCT Pub. No.: WO97/34445

PCT Pub. Date: Sep. 18, 1997

[30] Foreign Application Priority Data

Mar. 15, 1996 [NZ] New Zealand ..... 286193

[51] Int. Cl.[7] ..... H05B 6/10

[52] U.S. Cl. ..... 219/629; 219/628

[58] Field of Search ..... 219/629, 630, 219/631, 632, 660, 672, 438, 772

[56] References Cited

U.S. PATENT DOCUMENTS

| | | | |
|---|---|---|---|
| 1,981,632 | 11/1934 | Northrop | 219/629 |
| 2,494,716 | 1/1950 | McMahon et al. | 219/629 |
| 3,641,302 | 2/1972 | Sargeant | 219/772 |
| 3,777,117 | 12/1973 | Othmer | 392/469 |
| 4,233,494 | 11/1980 | Pawlik et al. | 392/488 |
| 4,341,936 | 7/1982 | Virgin | 219/630 |
| 4,471,191 | 9/1984 | Greis et al. | 219/10.51 |
| 4,560,849 | 12/1985 | Migliori et al. | 219/628 |
| 4,791,262 | 12/1988 | Ando et al. | 219/10.51 |
| 4,855,552 | 8/1989 | Marceau et al. | 219/630 |
| 5,319,170 | 6/1994 | Cassidy | 219/630 |
| 5,521,361 | 5/1996 | Strait, Jr. | 219/731 |
| 5,523,550 | 6/1996 | Kimura | 219/772 |
| 5,990,465 | 11/1999 | Nakaoka et al. | 219/629 |

FOREIGN PATENT DOCUMENTS

| | | | |
|---|---|---|---|
| 0075811 | 4/1983 | European Pat. Off. . | |
| 0462544 | 12/1991 | European Pat. Off. . | |
| 066045 | 6/1995 | European Pat. Off. . | |
| 1781845 | 12/1992 | Russian Federation | H05B 6/10 |
| 112315 | 11/1994 | Sweden | H05B 6/10 |
| 574805 | 1/1946 | United Kingdom | H05B 6/10 |
| WO89/12204 | 12/1989 | WIPO . | |
| WO91/19138 | 12/1991 | WIPO . | |
| WO93/12627 | 6/1993 | WIPO . | |

OTHER PUBLICATIONS

Derwent Abstract Accession No. 96–441670/44, RU 2053455 C, (ELSHIN A I), Jan. 27, 1996.

Patent Abstracts of Japan, p. 51, JP 56–127139 A, (SHINKO DENKI K.K.), Oct. 5, 1981.

Patent Abstracts of Japan, p. 58, JP 05–290960 A, (Mitubishi Electric Corp.), Nov. 5, 1993.

Derwent Abstract Accession No. 85–115079/19, SU 1119192 A, (SHPANKO IT), Oct. 15, 1984.

Healthcare Product Comparison System, "Blood Warmers", Mar. 1994.

*Primary Examiner*—Teresa Walberg
*Assistant Examiner*—Jeffrey Pwu
*Attorney, Agent, or Firm*—Jacobson, Price, Holman & Stern, PLLC

[57] ABSTRACT

An inductive fluid heater is constructed from two concentric tubular members forming a fluid chamber therebetween. Fluid is supplied into the chamber by way of a manifold at each end of the concentric tubular members. A heating device is located within the chamber where the heating device is in the form of a shorted secondary coil of a transformer. The shorted secondary coil is in the form of a conductive tube. The transformer further includes a primary coil, a central core and a plurality of side cores to form a continuous constrained flux path. The central core surrounded by the primary coil is inserted into the inner concentric tubular member of the fluid heater. The primary coil may be powered by an AC high frequency supplier. Potential applications include fluid heating in general, particularly medical applications where blood, plasma and the like are required to be heated at high flows rates and under highly controlled conditions.

14 Claims, 3 Drawing Sheets

FLUID HEATER

TECHNICAL FIELD

The present invention relates to a fluid heater. More particularly, although not exclusively, the present invention relates to an inductive fluid heater which is particularly suitable for heating blood, plasma or other medical fluids.

BACKGROUND TO THE INVENTION

While the present discussion is directed towards apparatus for heating blood or plasma, it is to be understood that the present invention may find application in other areas involving a range of geometries, capacities and subject liquids.

Blood and blood products are generally refrigerated for the purposes of storage at approximately 1–6 degrees celcius. Consequently, infusion of such fluids at below body temperature may result in shock, hypothermia or cardiac dysfunction. Additionally, such conditions can be aggravated by the infusion of physiologically cold fluids. Accordingly, it is known, indeed required, in the art to heat such fluids prior to infusion into a patient.

The minimum acceptable infusion temperature will depend on the condition of the patient, the duration of the infusion, the volume of liquid to be administered to the patient, and the patient's blood volume prior to infusion. However, generally the infusion temperature must be at least at or near the patient's body temperature.

In addition to the temperature criteria discussed above, it is known that the combination of insufficiently heated blood with high infusion rates can result in destabilisation of the patient's thermoregulatory system. Alternatively, excessive warming may damage the red blood cells.

Accordingly, it is vital that the infusion temperature be closely monitored and controlled in response to a particular patients physiological condition and the other factors mentioned above.

To the present time it is known to warm blood, plasma or other medical fluids, using water bath warming, circulating fluid and dry heat devices. Water bath blood warmers incorporate a warm water reservoir set to maintain a constant temperature of between approximately 36 and 40 deg C, a bag, or coil of tubing is immersed in the water bath. The blood or plasma is then warmed by passing it through the bag or coil prior to infusion. A variation on this is the counter flow circulating fluid device, where two concentric tubes form a heat exchanger, the blood or plasma to be heated is passed through the inner tube, while the heated fluid from the reservoir (usually water) is pumped in the opposite direction through the outer tube. Dry heat warmers warm the blood by passing it through tubing or a bag which is located between heating plates or by passing it through a disposable cuff style bag which is wrapped around a cylindrical heating element.

Many blood warming systems known in the art are significantly limited in that high infusion rates cannot be sustained in combination with sufficient blood heating. A further difficulty with prior art blood warming devices, particularly heated water bath units, is that the blood may become contaminated by contact with the heated liquid. It is of prime importance that the blood flowing through the blood warmer be contained within a sterile environment. Reported cases of blood contamination in the context of water bath blood heaters, indicates that this type of blood warmer is particularly susceptible to such contamination effects. While repeated and thorough cleaning of the water bath may avoid contamination, such processes can be time consuming and necessitate the dismantling of the blood warming device.

Another significant limitation of prior art blood warmers is that they generally, because of their construction, do not lend themselves to mobility and ease of use. Particularly in the context of field operation or warfare environments, where conventional blood heaters may be difficult to operate properly.

As noted above, the need for potentially high flow rates coupled with the requirement that the blood temperature be elevated and regulated precisely, means that conventional blood warming systems exhibit significant limitations in function and application. Accordingly, there exists a need for a blood warming unit which, amongst other things, is compact, portable, resistant to contamination and, most importantly, provides high flow rates in combination with precisely controlled heating.

A type of fluid warming device which represents a major departure from those known in the art is that which exploits inductive heating. Such devices are discussed in U.S. Pat. No. 5,319,170 (Cassidy) and PCT/GB89/00629 (Curran). Both of the devices described in these specifications incorporate a conductive heating element forming a shorted secondary winding of a transformer, which is magnetically coupled to a primary circuit powered by alternating current. The inductive coupling produces currents in the secondary thereby generating heat which is transmitted to the fluid in contact with the secondary. Such devices are advantageous in that they are electronically operated and are thus particularly useful for remote use. Use in remote locations does not lend itself to the application of relatively cumbersome water bath or similar blood heating units.

While the device described in Cassidy does, to some degree, overcome some of the above mentioned disadvantages, it is considered that blood travelling along different paths through the device will be subjected to different heating times, thereby raising the possibility of some of the blood being heated beyond its maximum permissible level. This could either result from paths being of different lengths, depending on their radius from the centre of the toroid, or from stagnation occurring such as in areas either side of the inlet port.

It is also believed that the relatively loosely coupled magnetic circuit used in the Cassidy device may result in unwanted electromagnetic emissions. Such emissions may interfere with monitoring equipment used in, for example, an operating theatre environment as well as electronic components in the patients immediate environment. It is also desirable to reduce the patient's exposure to unwanted electromagnetic fields. While the effect of such electromagnetic fields is still uncertain at this time, it is prudent to construct such a device so as to reduce unwanted electromagnetic emissions as effectively as possible.

The Curran device discloses an induction heater incorporating a mesh conductive heating element in the form of a spiral. The inner edge of the spiral is attached to the outer edge of the spiral by means of a shorting strap thereby forming a shorted secondary winding. However, the Curran device is constructionally complex in that the spiral wound heating element is formed from mesh and must be supported at either end by some suitable means and must also be shorted to render the secondary closed. Further, while the mesh structure of the heating element disrupts the axial flow of the fluid thereby causing transverse turbulence which may result in more homogeneous heating, it is likely that such turbulent flow may significantly reduce the flow rate through the device. Further, being coreless the Curran device will have a relatively loosely coupled magnetic circuit. In situations such as this, where the field is less constrained, to increase the magnetic flux density a greater number of turns on the primary are required. This will result in a bulkier, more expensive and potentially less efficient unit.

Further, it is believed that the Curran device will produce more electromagnetic noise than a central core device having a more tightly constrained magnetic circuit.

Accordingly, it is an object of the present invention to provide an inductive fluid warmer which is compact, light and portable, of simple construction and with the heat exchanger chamber consisting of a cheap disposable cartridge that is not susceptible to contamination by a thermally coupled heating means, poses a minimal or reduced risk of electromagnetic interference or at least mitigates some to the above mentioned disadvantages and it provides the public with a useful choice.

DISCLOSURE OF THE INVENTION

In one aspect the invention provides for a fluid heater comprising:

two concentric tube members forming a chamber therebetween;

a manifold at each end of said concentric tube members, said manifolds adapted to provide substantially uniform flow of a liquid through the chamber; and one or more heating means located within the chamber, the heating means incorporates corrugations running parallel to the longitudinal axis of the fluid heater wherein the heating means is adapted to constitute a shorted secondary coil in a transformer.

Preferably the heating means comprises a conductive tube.

Preferably the dimensions of the conductive tube and the chamber are such that two concentric volumes are formed between the three concentric tubes.

Preferably the conductive tube and the concentric tube members are in the form of cylinders.

Preferably the corrugations run substantially parallel to the longitudinal axis of the fluid heater.

Preferably the concentric tubes and heating element are closely spaced so as to reduce the required priming volume of the heat exchanger chamber and to maximise the proportion of the fluid in direct contact with the element.

Preferably the fluid heater incorporates one or more temperature sensors located so that the temperature of the liquid flowing through the liquid heater may be monitored.

Preferably the temperature sensors are infra-red temperature sensors or other temperature sensing devices, wherein the concentric cylinders are adapted to accommodate the function and location of the infra-red sensors.

Preferably, the concentric cylinders are formed from a material which allows measurement of the temperature by means of infra-red sensors located proximate the concentric cylinders.

Preferably, the fluid heater incorporates a first infra-red sensor located proximate the first inlet port and a second infra-red sensor located proximate the second port, said port adapted to allow the function and location of said infra-red sensors.

Preferably the one or more heating means is inductively coupled to a primary winding, forming a transformer.

Preferably said coupling comprises inserting a core of a transformer surrounded by a primary winding through the centre of fluid heater substantially parallel with the liquid heater longitudinal axis heating element.

Preferably, the core of the transformer is coupled to one or more transformer arms thereby forming a continuous constrained flux path through the transformer.

Preferably the alternating primary current is high frequency, thus allowing the transformer core to be smaller, lighter and the number of primary turns to be fewer for a given design.

BRIEF DESCRIPTION OF DRAWINGS

The invention will now be described by example only and with reference to the drawings in which.

While the present invention is described below as applied to the heating of blood or plasma, it is to be understood that the inductive heater described herein may be used to heat a variety of fluids in a number of different situations and applications. Further, the geometry of the heater may be varied to suit a particular application or situation as can the shape of the conductive heater element, the number of inlet and outlet ports and other features.

Figure 1:
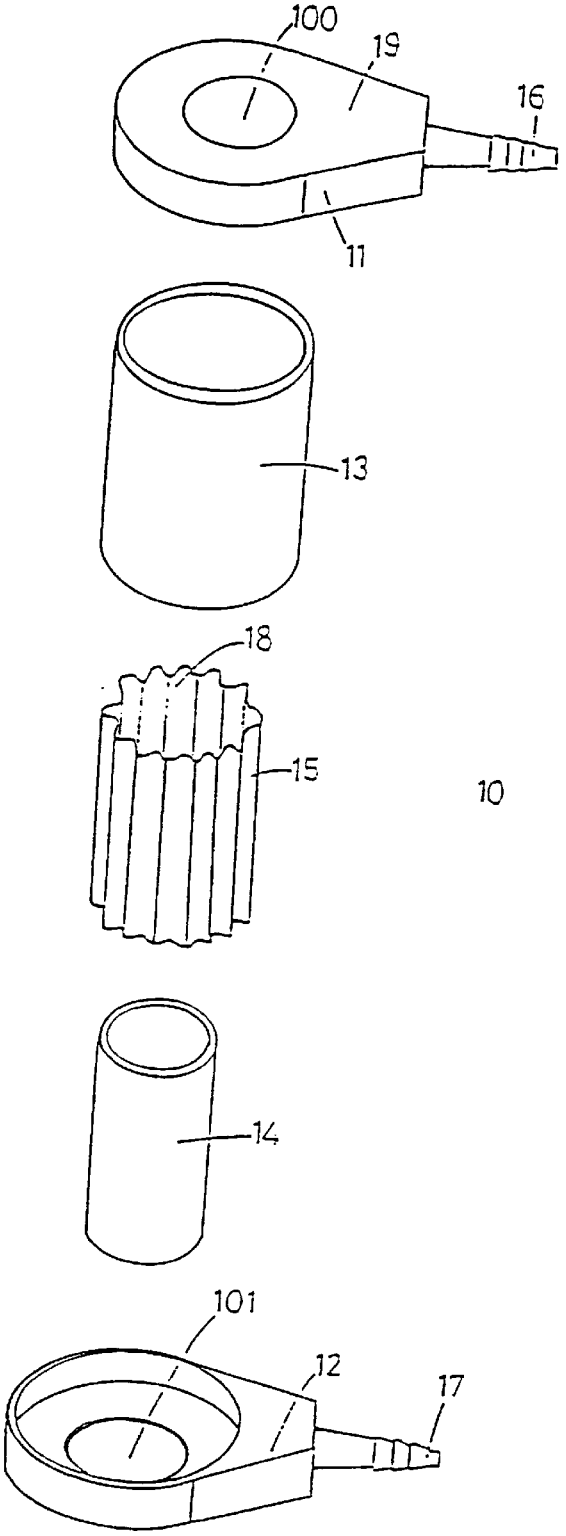
FIG. 1 illustrates an exploded view of a fluid heater.

Referring to FIG. 1, an exploded view of the heat exchange cartridge component 10 of an inductive heater is shown. Concentric tubes, in this embodiment cylinders 13 and 14, define an annular volume therebetween. The concentric cylinders are capped at each end by manifolds 12 and 11. The manifolds incorporate apertures 100 and 101 which allow the insertion of the transformer coil incorporating the primary winding. The manifolds seal the ends of the concentric cylinders 13 and 14, whereby fluid entering the inlet port 16 flows uniformly around the perimeter of the manifold 19 whereupon it flows through the annular volume and into the outlet manifold 12 and exits via the outlet port 17. Thus a single flow path is produced through the heat exchange cartridge.

The inlet and outlet port 16 and 17 respectively may comprise standard intravenous fittings known in the art. The inlet manifold 19 may incorporate a plurality of passages branching off from its port 16, and connecting to the manifold/annular volume junction, thereby increasing the uniformity of the liquid flow into the manifold and thus into the annular volume. The same applies to the outlet manifold 12 and outlet port 17.

A heating element 15 is inserted into the annular volume. In this particular embodiment, the heating element is in the form of a cylindrical conductor having corrugations running axially. The corrugations increase the surface area of the heating element thereby increasing the heating capacity of the blood warmer, as well as enhancing the flow. Flow paths are established running along the corrugations, thereby advantageously producing a very uniform flow with an attendant homogeneity in the thermal characteristics on the fluid.

It is envisaged that the heating element 15 may be in the form of a cylinder constructed from flat sheet conductor. Alternatively, the heating element may be formed from conducting mesh or the like.

The heating element 15 acts as a secondary winding of the transformer when the heat exchanger cartridge is in place. While the geometry of the blood warmer shown in FIG. 1 is cylindrical, the present construction lends itself to adaption to other cross-sectional shapes such as square or rectangular. Such geometries may be suitable in certain applications. However, such an embodiment is less preferred as the degree of homogeneity of fluid flow is unlikely to be as uniform as that in the cylindrical embodiment.

Figure 2:
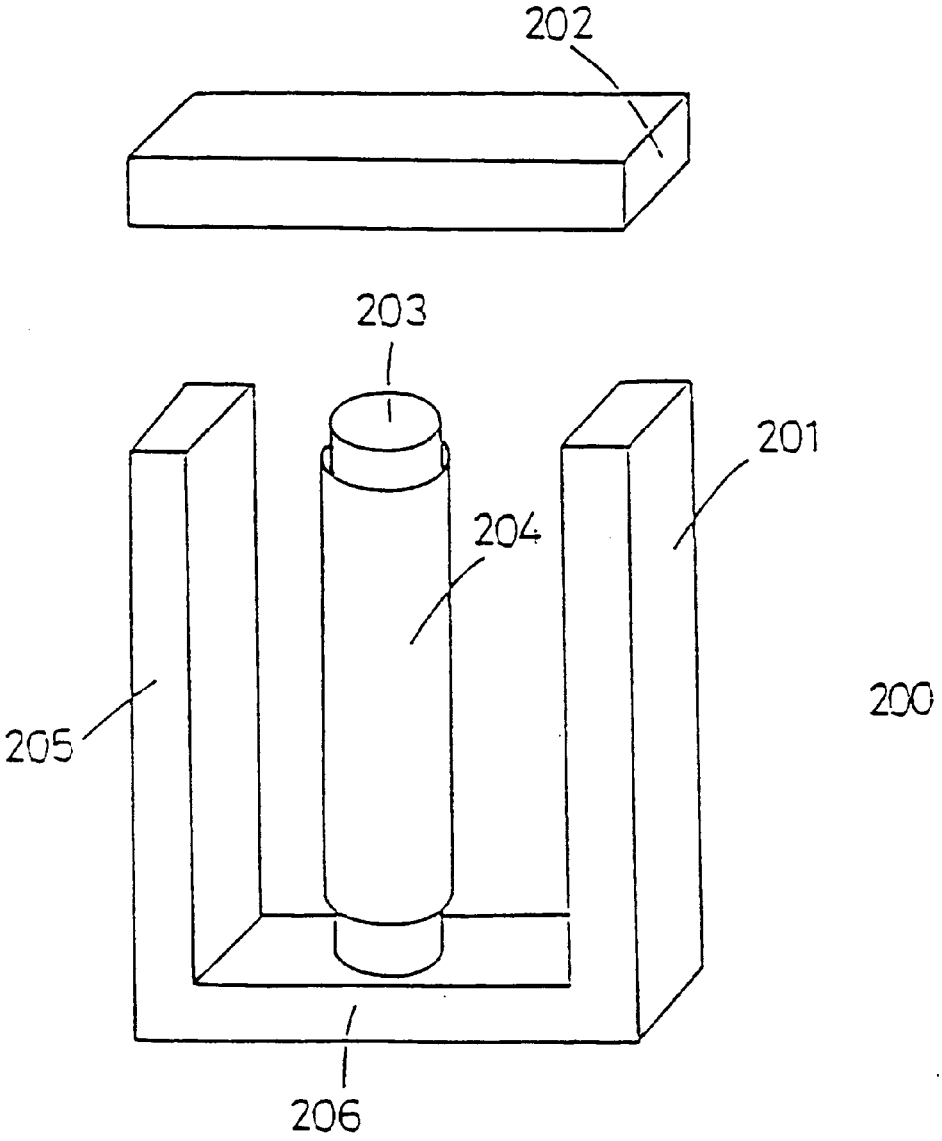
FIG. 2 illustrates a perspective view of a transformer with a top arm removed.

FIG. 2 illustrates an exploded view of a transformer suitable for powering the blood warmer shown in FIG. 1. A primary coil 204 is wound either directly onto a core 203 or wound onto a cylindrical sheath (not shown) which is then slid onto the core 203. Outer arms 201 and 205 along with end pieces 202 and 206 form closed field paths thereby providing a relatively tightly coupled magnetic field in the transformer arms and core. Such a configuration is desirable as it will reduce electromagnetic emissions from the device when in operation. In alternative embodiments, the cross-sectional shape of the transformer core 203 may be square or rectangular. However, the shape shown in FIG. 2 is particularly adapted for use with the cylindrical heat exchange cartridge shown in FIG. 1.

Figure 3A:
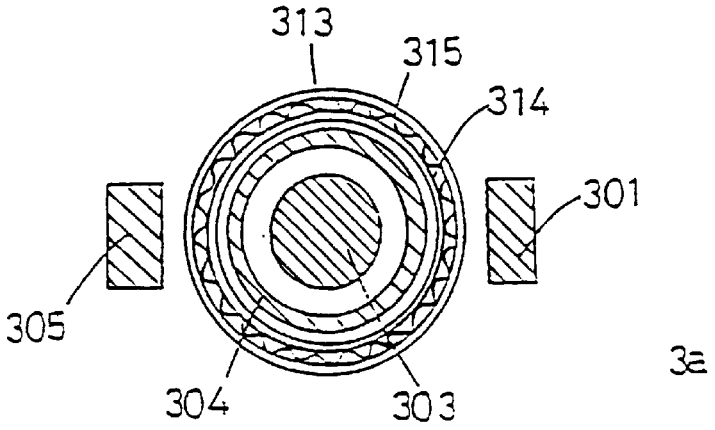
FIGS. 3*a* & 3*b* illustrates a sectional and side view respectively of a liquid warmer.
Figure 3B:
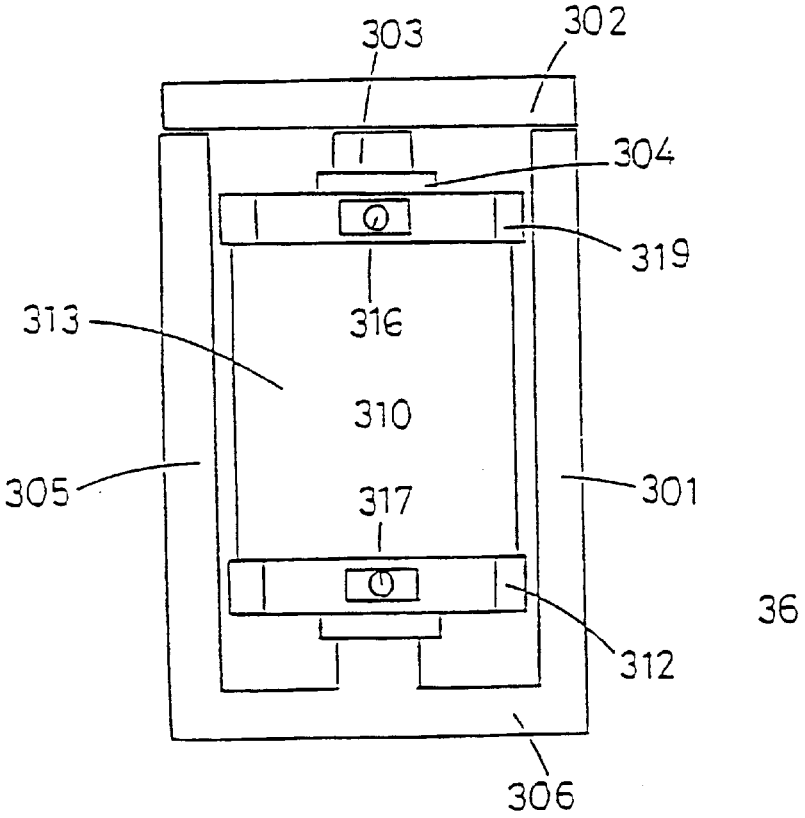

FIG. 3*a* shows a cross-section of the assembled blood warmer viewed from above. Concentric cylinders 314 and 313 form an annular volume containing the corrugating cylindrical heating element 315. Manifolds 319 (FIG. 3*b*) and 312 seal the ends of the annular volume and provide uniform fluid flow entry and egress. The assembled heat exchange cartridge is slid onto the core 303 and primary winding 304 whereupon the upper arm 302 is fixed into place thus completing the magnetic circuit. It can thus be seen that disposable heat exchange cartridge can be readily and quickly positioned for operation. The primary winding 304 is generally wound onto a former which is then slid onto the core 303. When an AC voltage is applied to the primary winding 304 currents are induced in the shorted secondary winding ie. the heating element 315. Thus there is no physical connection between the heating element and the power source and the heating element 315 is completely isolated in the sterile annular flow path. Such a construction is particularly advantageous in that there is no risk of contamination between the fluid being heated and any potentially non-sterile heating medium.

Further, the unit 310 may be constructed as a disposable heat exchanger cartridge. Such a cartridge may be easily removed when the infusion is complete and replaced with a sterile unit prior to the next infusion. The disposable heat exchange cartridge is made from relatively cheap materials and will lend itself well to mass production techniques. The heating element 315 may be formed from stainless steel or a similar material exhibiting desirable properties in terms of sterility, heat conduction, electrical resistivity and the like.

While the particular embodiments shown incorporates a single inlet and outlet port, it is envisaged that additional manifolds may be provided if required along the length of the heat exchange cartridge.

It is also possible that the transformer may be constituted solely from a single core passing through the centre of the heat exchange cartridge. The relatively loosely coupled magnetic field renders this embodiment a less preferred version. However, such a construction is feasible and is intended to be included with the scope of the present invention.

As discussed above, it is vital that the temperature be monitored precisely. Conventionally, this is done by means of a thermocouple temperature sensor or the like. This technique introduces a component into the fluid flow which may cause contamination and adds complexity to the construction of such a device. It is envisaged that a particularly suitable means of monitoring the temperature, in the present apparatus, is by means of one or more infra-red temperature sensors. Such sensors are completely non-intrusive in terms of contact with the fluid being heated. Further, infra-red sensors can be located at the inlet and outlet ports of the heat exchange ports of the heat exchange cartridge thereby providing a means of determining the temperature gradient through the cartridge where upon such signals may be readily utilised by microprocessing means, or other control circuitry, in order to regulate the current in the primary and thus the amount of heating.

The heating may further be controlled by means of varying the flow rate. Such a variation will expose the blood to the heat transfer environment for different periods of time thus heating the fluid to a different temperature.

The heat exchange cartridge of the present invention incorporates a heating element with very low mass and, preferably, high surface area. This results in the heating element exhibiting a relatively low thermal time constant. This is advantageous in that the temperature can be varied rapidly in response to variations in the inlet fluid temperature and flow rate thus providing a reliable and constant temperature at the outlet.

Further, the temperature sensors may provide additional information in terms of the fluid flow rate which can be derived from the temperature gradient in a section of the uniformly heated or cooled tubing and the known input power and efficiency.

While the particular example given is in the form of a cylindrical heat exchange cartridge, the geometry of a particular embodiment may be varied depending on the power output, required flow rate, application, fluid velocity, minimum and maximum acceptable temperature gradients, materials used in construction, manufacturing limitations, whether the heat exchange cartridge is required to be disposable and the environment in which the heating device is to operate. Numerous modifications and improvements will be clear to one skilled in the art.

The heating unit described herein is significantly more compact and lighter than those known in the art, significantly more simple in construction (particularly in contrast with the Cassidy device which incorporates a multitude of heating disks) and is less prone to leaks and contamination. The present heating device also is advantageous in that it is possible to maintain a constant temperature over a wide range of flow rates as opposed to water bath systems where the temperature tends to drop off as flow rate increases. Further, the present invention provides a more uniform flow path due to the flow along each corrugation being substantially identical. This will result in extremely uniform heating and the avoidance of hot spots. Again, this contrasts to the Cassidy device where the flow paths are of varying lengths thus subjecting the blood to varying heating times.

Where in the foregoing description reference has been made to elements or integers having known equivalents, then such equivalents are included as if they were individually set forth.

Although the invention has been described by way of example and with reference to a particular embodiment, it is to be understood that modifications and/or improvements may be made without departing from the scope of the appended claims.

What is claimed is:

1. A fluid heater comprising:

two concentric tube members forming a chamber therebetween;

a manifold at each end of said concentric tube members, said manifolds adapted to provide substantially uniform flow of a liquid through the chamber; and one or more heating means located within the chamber, the heating means incorporates corrugations running substantially parallel to the longitudinal axis of the fluid heater wherein the heating means is adapted to constitute a shorted secondary coil in a transformer.

2. A fluid heater as claimed in claim 1 wherein the heating means comprises a conductive tube.

3. A fluid heater as claimed in claim 2 wherein the dimensions of the conductive tube and the chamber are such that two concentric volumes are formed between the three concentric tubes.

4. A fluid heater as claimed in claim 1 wherein the conductive tube and concentric tube members are in the form of cylinders.

5. A fluid heater as claimed in claim 1 wherein the concentric tubes and heating element are closely spaced so as to reduce the required priming volume of the chamber and to maximise the proportion of the fluid in direct contact with the element.

6. A fluid heater as claimed in claim 1 wherein the fluid heater incorporates one or more temperature sensors located so that the temperature of the liquid flowing through the liquid heater may be monitored.

7. A fluid heater as claimed in claim 1 wherein the temperature sensors are infra-red temperature sensors.

8. A fluid heater as claimed in claim 7 wherein the concentric cylinders are adapted to accommodate the function and location of the infra-red sensors.

9. A fluid heater as claimed in claim 7 wherein the concentric cylinders are formed from a material which allows measurement of the temperature by means of infra-red sensors located proximate the concentric cylinders.

10. A fluid heater as claimed in claim 1 wherein the fluid heater incorporates a first infra-red sensor located proximate the first inlet port and a second infra-red sensor located proximate the second port, said port adapted to allow the function and location of said infra-red sensors.

11. A fluid heater as claimed in claim 1 wherein the one or more heating means is inductively coupled by a coupling to a primary winding, forming a transformer.

12. A fluid heater as claimed in claim 1 wherein said coupling comprises inserting a core of a transformer surrounded by a primary winding through the centre of fluid heater substantially parallel with the liquid heater longitudinal axis heating element.

13. A fluid heater as claimed in claim 1 wherein the core of the transformer is coupled to one or more transformer arms thereby forming a continuous constrained flux path through the transformer.

14. A fluid heater as claimed in claim 1 wherein the alternating primary current is high frequency, thus allowing the transformer core to be smaller, lighter and the number of primary turns to be fewer for a given design.

* * * * *